US009041614B2

(12) United States Patent
Scott

(10) Patent No.: US 9,041,614 B2
(45) Date of Patent: May 26, 2015

(54) RF APERTURE COLDPLATE

(71) Applicant: Raytheon Company, Waltham, MA (US)

(72) Inventor: Gordon R. Scott, Farmersville, TX (US)

(73) Assignee: RAYTHEON COMPANY, Waltham, MA (US)

( * ) Notice: Subject to any disclaimer, the term of this patent is extended or adjusted under 35 U.S.C. 154(b) by 30 days.

(21) Appl. No.: 13/758,981

(22) Filed: Feb. 4, 2013

(65) Prior Publication Data

US 2014/0238631 A1 Aug. 28, 2014

Related U.S. Application Data

(62) Division of application No. 12/609,563, filed on Oct. 30, 2009, now Pat. No. 8,384,609.

(51) Int. Cl.

| | |
|---|---|
| ***H01Q 13/10*** | (2006.01) |
| ***H01Q 21/00*** | (2006.01) |
| ***H01Q 1/02*** | (2006.01) |
| ***H01Q 21/06*** | (2006.01) |

(52) U.S. Cl.

CPC ..... *H01Q 21/0087* (2013.01); *H01Q 1/02* (2013.01); *H01Q 21/062* (2013.01)

(58) Field of Classification Search

CPC ..... H01Q 21/0087

USPC ..... 343/700 MS, 771, 772; 29/600

See application file for complete search history.

(56) References Cited

U.S. PATENT DOCUMENTS

| | | | | |
|---|---|---|---|---|
| 3,530,478 | A * | 9/1970 | Mosko et al. | 343/771 |
| 4,255,752 | A * | 3/1981 | Noble et al. | 343/771 |
| 4,613,869 | A * | 9/1986 | Ajioka et al. | 343/768 |
| 5,327,150 | A * | 7/1994 | Cherrette | 343/771 |
| 5,689,275 | A * | 11/1997 | Moore et al. | 343/786 |
| 7,379,023 | B2 * | 5/2008 | Yamanaka et al. | 343/700 MS |
| 7,450,071 | B1 * | 11/2008 | Volman | 343/700 MS |
| 7,889,135 | B2 | 2/2011 | Blaser et al. | |
| 8,081,134 | B2 | 12/2011 | Raby et al. | |
| 8,384,609 | B2 | 2/2013 | Scott | |
| 2005/0219137 | A1 | 10/2005 | Heisen et al. | |

* cited by examiner

*Primary Examiner* — Tho G Phan

(74) *Attorney, Agent, or Firm* — Christie, Parker & Hale, LLP

(57) ABSTRACT

An RF aperture coldplate for positioning in heat transfer proximity to heat-generating elements of an RF antenna system is presented. The RF aperture coldplate has a front side and a rear side. The RF aperture coldplate includes waveguides each forming an opening therethrough from the front side to the rear side, and passages substantially around the waveguides. The passages are configured to conduct cooling medium around the waveguides and between the front side and the rear side of the RF aperture coldplate.

7 Claims, 5 Drawing Sheets

RF APERTURE COLDPLATE

CROSS-REFERENCE TO RELATED APPLICATION(S)

This application is a divisional of U.S. patent application Ser. No. 12/609,563, filed Oct. 30, 2009, entitled RF APERTURE COLDPLATE, the contents of which are expressly incorporated herein in its entirety.

BACKGROUND

1. Field of the Invention

The present invention relates to an RF (radio frequency) aperture coldplate.

2. Description of Related Art

RF systems have been developed to provide information of a scene or other useful data to a user or other system. RF systems may be adapted to function at different frequency bands. For example, RF systems such as radar and communication systems may operate in the X-band (8.0-12.0 GHz) or the Q-band (40.0-60.0 GHz), respectively. Sub-bands of these established bands may be used for specific purposes. For example, satellite communication systems may operate in the 40.0-45.0 GHz sub-band of the Q-band (40.0-60.0 GHz). One of ordinary skill in the art would understand that RF systems may function in one or more frequency bands.

Depending on the specific application, RF systems may be mounted in a variety of vehicles (e.g., air, ground, sea), ground stations (or other suitable permanent or semi-permanent ground fixtures), or satellites (or other spacefaring vehicles). One of ordinary skill in the art would understand that an RF system designer chooses hardware and integrates software to be used for operation with these specific applications in mind. For example, an RF system operating in the satellite communications sub-band of the Q-band may require hardware and software specifically developed for the physical and electrical characteristics of generating and propagating RF signals in the 40.0-45.0 GHz frequency band.

RF systems generally utilize antennas to transmit and receive RF signals. For example, RF systems utilize reflectors, horns, dipoles, phased arrays, and other antenna elements. RF systems using antenna arrays usually require an antenna plate to arrange the antenna elements. Certain RF systems that use circular elements perform in tandem with circular waveguides foamed in the antenna plate itself.

Modern RF systems generally are cooled with air or liquid. Coldplates are formed as plates with hollow passages inside to circulate cooling medium (e.g., air or liquid) near heat generating elements of an RF system. For example, monolithic microwave integrated circuits (MMICs) generate a high amount of heat, and a coldplate may be used to draw heat away from such heat generating elements to increase performance or reduce component failure. Generally, it is advantageous to place the coldplate as close to heat generating elements as possible.

A traditional RF system includes a printed circuit board (PCB) composed of copper, which includes electrical components and wiring to generate and route the RF signals. Such RF systems typically have coldplates mechanically fixed to the PCB. Because the coldplate must mate securely, there is typically very little mechanical tolerance between the PCB and the coldplate. In an RF system where it is desirable to use an antenna plate having circular waveguides, the antenna plate must also be securely fixed to the PCB (on the opposite side of the coldplate). There is typically very little mechanical tolerance between the PCB and the antenna plate. Such systems are generally built from the back to the front, such that a coldplate is fixed to a PCB copper plate on one end and an antenna plate is fixed to the PCB copper plate on the other end. Both PCB/coldplate and PCB/antenna plate interfaces must mate securely. If there are gaps in the PCB/coldplate interface, there is a decrease in cooling performance. If there are gaps in the PCB/antenna plate interface, there is a decrease in electrical interface performance.

SUMMARY OF THE INVENTION

Exemplary embodiments according to the present invention provide an RF aperture coldplate for positioning in heat transfer proximity to heat-generating elements of an RF antenna system. The RF aperture coldplate has a front side and a rear side, and includes waveguides each forming an opening through the RF aperture coldplate from the front side to the rear side. The RF aperture coldplate further includes passages substantially around the waveguides for conducting cooling medium around the waveguides and between the front side and the rear side of the RF aperture coldplate.

The RF aperture coldplate may further include at least one recess on the rear side extending from one of the waveguides to another of the waveguides.

According to another exemplary embodiment in accordance with the present invention, there is provided an RF antenna system. The RF antenna system includes an RF aperture coldplate having a front side and a rear side. The RF aperture coldplate includes waveguides each forming an opening through the RF aperture coldplate from the front side to the rear side, passages substantially around the waveguides for conducting cooling medium around the waveguides and between the front side and the rear side of the radio-frequency aperture coldplate, and at least one recess on the rear side extending from one of the waveguides to another of the waveguides. The RF antenna system further includes a printed wiring board assembly configured to be received by the at least one recess of the RF aperture coldplate. The printed wiring board assembly includes at least one printed wiring board and microwave integrated circuits. The microwave integrated circuits are each aligned with a respective one of the waveguides. The RF antenna system further includes a dielectric positioned substantially within each of the plurality of waveguides.

The RF antenna system may further include an RF matching layer coupled with and opposing the RF aperture coldplate and the dielectric.

The RF antenna system may further include dipoles each positioned substantially within a respective one of the waveguides.

The RF antenna system may further include an enclosure for receiving the RF aperture coldplate. The enclosure includes at least one inlet for supplying the cooling medium to the passages of the RF aperture coldplate, and at least one outlet for expelling the cooling medium from the passages of the RF aperture coldplate.

According to another exemplary embodiment in accordance with the present invention, there is provided a method of manufacturing an RF aperture coldplate. The RF aperture coldplate has a front side and a rear side, and includes waveguides each forming an opening through the RF aperture coldplate from the front side to the rear side. First, a plate is formed with a first material susceptible to being dissolved by a caustic material. The plate has holes formed therethrough. Then, a front surface, a rear surface and the holes of the plate are coated with a second material resistive to the caustic material. The plate is dissolved with the caustic material such that the second material forms the RF aperture coldplate.

BRIEF DESCRIPTION OF THE DRAWINGS

A more complete appreciation of the present invention, and many of the attendant features and aspects thereof, will become more readily apparent as the invention becomes better understood by reference to the following detailed description when considered in conjunction with the accompanying drawings in which like reference symbols indicate like components, wherein.

DETAILED DESCRIPTION

The present invention will now be described more fully with reference to the accompanying drawings, in which exemplary embodiments thereof are shown. The invention may, however, be embodied in many different forms and should not be construed as being limited to the embodiments set forth herein. Rather, these embodiments are provided so that this disclosure is thorough and complete, and will fully convey the concept of the present invention to those skilled in the art.

Accordingly, there is presented an RF antenna system in accordance with embodiments of the present invention including an RF aperture coldplate, in which the RF aperture coldplate functions as a coldplate for circulating cooling medium in close proximity to heat generating elements of an RF system, and as an antenna plate, for use with circular waveguide antenna elements. The RF antenna system presented herein may provide increased cooling performance and reduces mechanical tolerance issues for ease in manufacturing.

Figure 1:
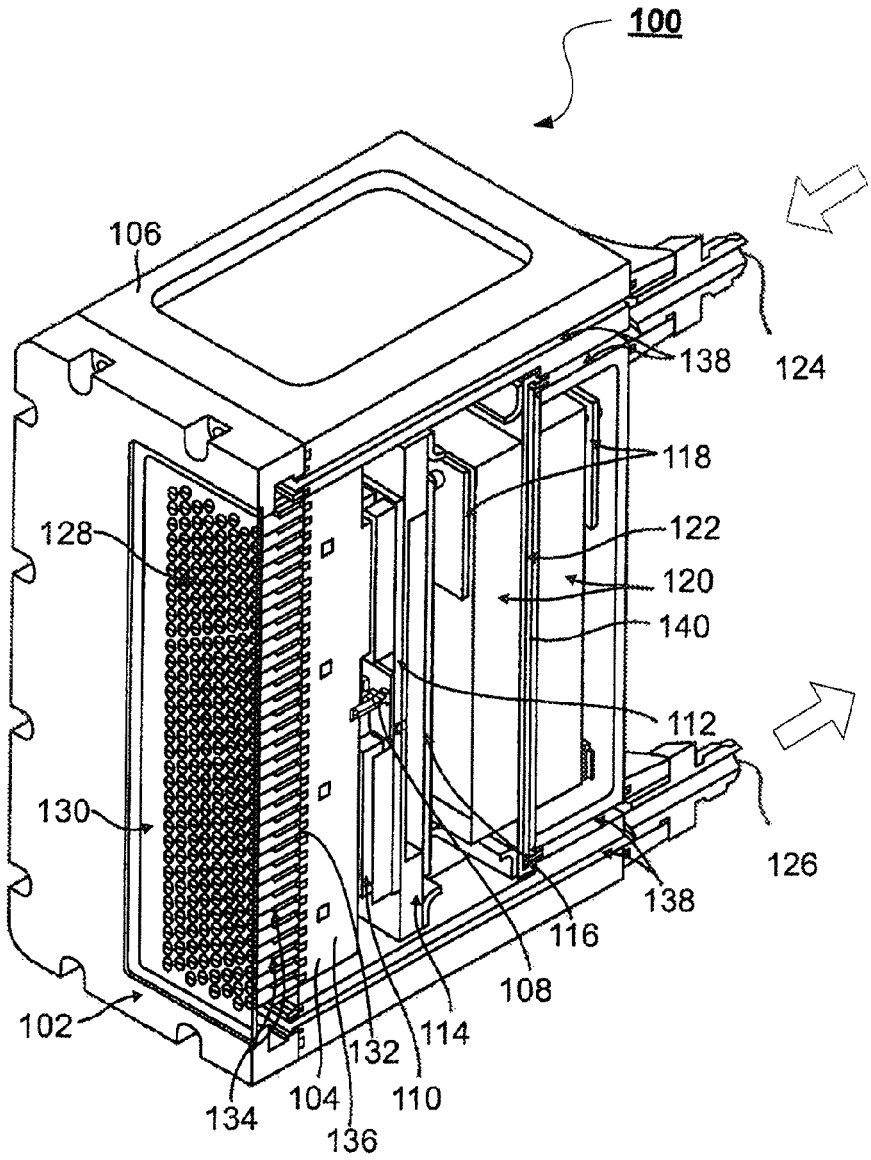
FIG. 1 is a schematic block diagram illustrating an RF antenna system in accordance with an embodiment of the present invention.

FIG. 1 is a schematic block diagram illustrating an RF antenna system in accordance with an embodiment of the present invention.

Referring now to FIG. 1, an RF antenna system 100 in accordance with an embodiment of the present invention includes an RF aperture coldplate 102, a printed wiring board assembly 104 (e.g., a plurality of transmit-receive integrated microwave modules, or TRIMMs), an enclosure 106, RF connectors 108, direct current (DC) power connectors 110, a manifold 112, a support 114, a beam steering computer 116, power supply connectors 118, power supply modules 120, a power supply coldplate 122, a cooling medium inlet 124, and a cooling medium outlet 126.

The RF aperture coldplate 102 is configured to function both as an RF antenna plate and a coldplate. An RF antenna plate, for example, includes circular waveguides configured to be partially filled with a dielectric material (not shown). The dielectric material fills the front end of each of the waveguides, for the purpose of propagating the RF signal through the dielectric material (e.g., the feed radiators inject the RF signal into the dielectric material because there is air behind the feed radiators, creating an electrical back-short due to the waveguide being below cut-off). A coldplate, for example, includes passages to conduct cooling medium therethrough. Generally, one of ordinary skill in the art would understand that the closer the coldplate is located to heat-generating elements of a system, the more efficient the cooling properties of the coldplate. The RF aperture coldplate 102 includes waveguides 128 each forming an opening through the RF aperture coldplate 102 from a front side 130 of the RF aperture coldplate 102 to a rear side 132 of the RF aperture coldplate 102, and a plurality of passages 134 substantially around the waveguides 128 for conducting cooling medium around the waveguides 128 and between the front side 130 and the rear side 132. In other words, the RF aperture coldplate 102 is hollow between the front side 130 and the rear side 132 and around the waveguides 128. In an embodiment, for example, the RF antenna coldplate 102 includes recesses (not shown in FIG. 1) on the rear side 132 extending from one of the waveguides 128 to another one of the waveguides 128.

The printed wiring board assembly 104, for example, includes printed wiring boards 136, each configured to be received by one of the recesses (not shown), and microwave integrated circuits (MICs, or monolithic microwave integrated circuits, MMICs, not shown in FIG. 1). In an embodiment, the printed wiring board assembly 104 includes radiators (not shown) each consisting of a dipole (not shown in FIG. 1) arranged on a corresponding one of the printed wiring boards 136, and internal wiring of the printed wiring boards 136. One of ordinary skill would understand that the dipoles may be provided independently of the printed wiring board assembly 104, and affixed thereon. One of ordinary skill in the art would understand that although dipoles may be used in connection with the printed wiring board assembly 104, other antenna elements may be used depending on the specific application.

The enclosure 106, for example, is composed of an integral structure having channels 138 to receive cooling medium from the cooling medium inlet 124, and to expel the cooling medium from the enclosure 106 through the cooling medium outlet 126. The enclosure 106 is configured to receive the RF aperture coldplate 102, the printed wiring board assembly 104, the support 114, and the power supply coldplate 122. The channels 138 are configured to conduct the cooling medium through the plurality of passages 134 of the RF aperture coldplate 102, and a passage 140 of the power supply coldplate 122 between the power supply modules 120. FIG. 1 shows the direction of flow of the cooling medium as it flows in through the cooling medium inlet 124, through the channels 138, through the passages 134 and the passage 140, and out through the cooling medium outlet 126.

The RF connectors 108, for example, collect RF signals from the printed wiring boards 136 and transmit the RF signals to an RF transmitter and/or receiver (not shown). The RF connectors 108 may be blind mate coaxial connectors, and couple the printed wiring boards 136 with the manifold 112.

The DC power connectors 110, for example, provide electrical interconnectivity between the power supply modules 120 and the printed wiring boards 136. The DC power connectors 110 also may supply control signals between the printed wiring boards 136 and the power supply modules 120.

The manifold 112, for example, is configured to provide a platform for the RF connectors 108, the DC power connectors 110, and other connectors (not shown). The RF connectors 108 and the DC power connectors 110 are coupled to the manifold 112. The manifold 112, for example, is configured to provide general interconnectivity for both DC power and RF signals between the printed wiring boards 136 and the beam steering computer 116.

The support 114, for example, is a mechanical structure connected to the manifold 112 to provide mechanical support for the manifold, the RF connectors 108, the DC power connectors 110, the printed wiring board assembly 104, and the beam steering computer 116. For example, the support 114 is a metal support, such as aluminum. One of ordinary skill in the art would understand that the support 114 may be formed of various materials depending on the specific application.

The beam steering computer 116, for example, is a printed wiring board configured to provide calculation of phase shifts in an active electronically scanned array, and to drive the radiating elements of the array. The beam steering computer 116 may include a memory (not shown) to store calibration tables. The calibration tables are configured to compensate for mechanical tolerance issues measured after manufacture of the antenna array elements. For example, different distances between the antenna array elements may require compensation and calibration of the phases of corresponding elements.

The power supply connectors 118, for example, are printed wiring boards having connectors thereon, which are configured to provide electrical power connectivity for the terminals of the power supply modules 120. The power supply connectors 118 may include a plurality of pins (not shown) soldered to the power supply modules 120. One of ordinary skill in the art would understand that different types of power connectors may be used depending on the specific application.

The power supply modules 120, for example, are configured to regulate and supply power to the radiating elements of the RF system. For example, the power supply modules 120 include DC-DC power converters, which receive external power and provide regulated power to be used to drive the antenna array elements. The power supply modules 120 may also be used to provide electrical isolation for Electromagnetic Interference (EMI) purposes.

The power supply coldplate 122, for example, is configured to draw away heat from the power supply modules 120. The power supply coldplate 122 may be formed of a metal, such as aluminum, and may be vacuum-braised to provide a hollow metal structure. One of ordinary skill in the art would understand that the power supply coldplate 122 may be formed of various materials depending on the specific application. Cooling medium may be conducted through the power supply coldplate 122 to draw away heat from the power supply modules 120.

The cooling medium inlet 124, and the cooling medium outlet 126, for example, are configured to supply cooling medium to the enclosure 106, and to expel the cooling medium from the enclosure 106, respectively. The cooling medium inlet 124 and the cooling medium outlet 126 may include quick disconnect connectors, configured to easily connect and disconnect the cooling medium supply to the passages of the power supply coldplate 122 and the RF antenna coldplate 102. The cooling medium, for example, may include ethylene glycol, propylene glycol, air, polyalphaolefin (PAO), or other coolants. The heat-generating elements of the RF antenna system 100 may also be cooled with water below atmospheric pressure, or sub-ambient cooling. One of ordinary skill in the art would understand that different cooling mediums may be used depending on the specific application.

Figure 2:
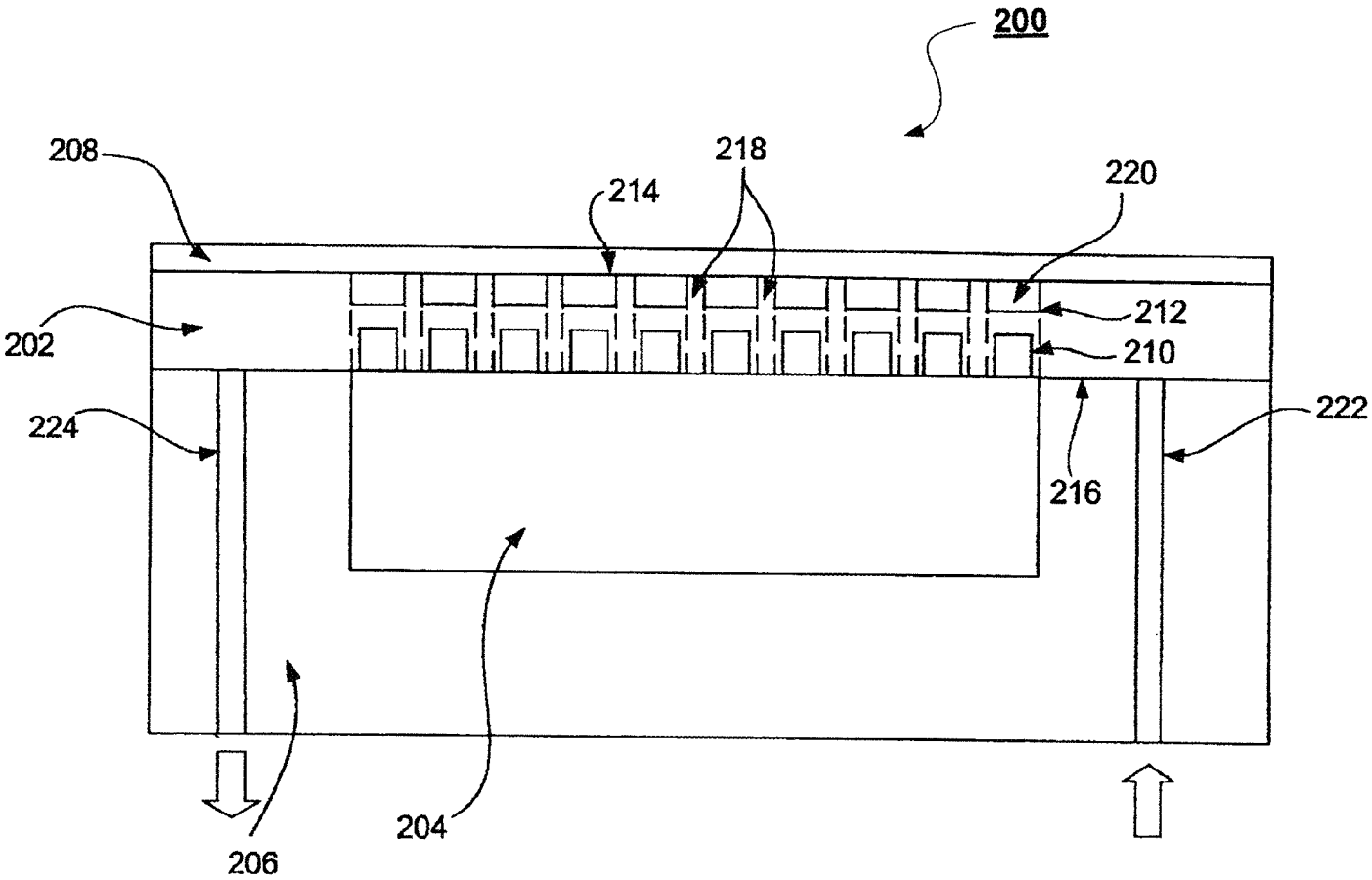
FIG. 2 is a simplified schematic block diagram illustrating an RF antenna system in accordance with an embodiment of the present invention.

FIG. 2 is a simplified schematic block diagram illustrating an RF antenna system in accordance with an embodiment of the present invention.

Figure 3:
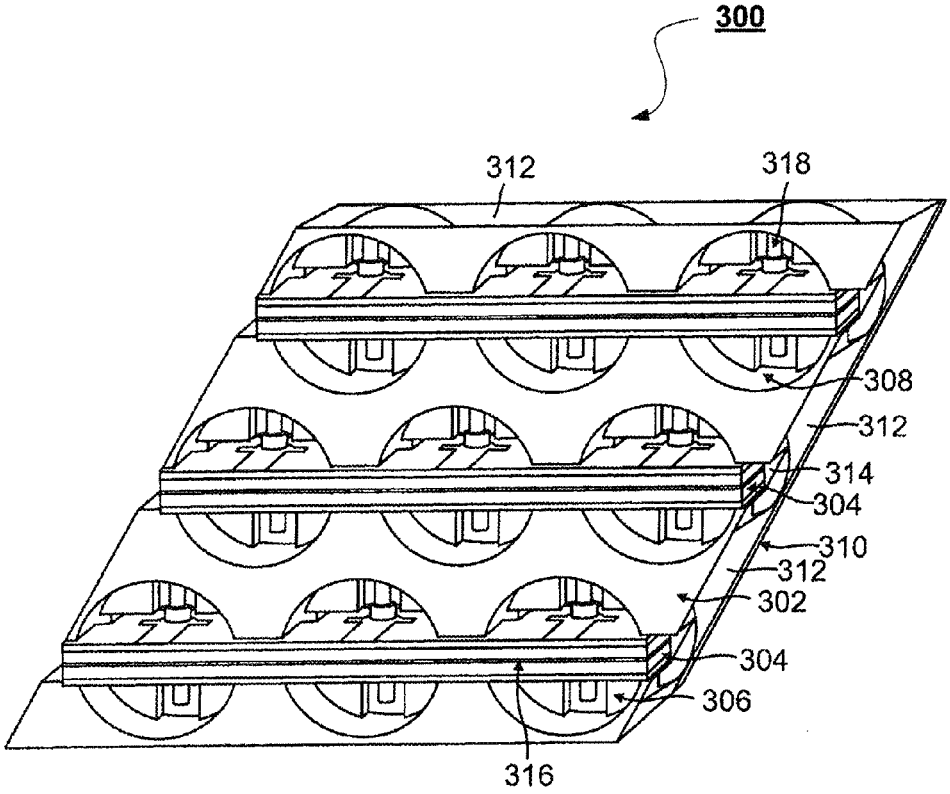
FIG. 3 is a cross-sectional schematic block diagram illustrating an RF antenna system in accordance with an embodiment of the present invention.

The RF aperture coldplate 202 is configured to function both as an RF antenna plate and a coldplate. The RF aperture coldplate 202 includes waveguides 212 each forming an opening through the RF aperture coldplate 202 from a front side 214 of the RF aperture coldplate to a rear side 216 of the RF aperture coldplate 202, and a plurality of passages 218 substantially around the waveguides 212 for conducting cooling medium around the waveguides 212 and between the front side 214 and the rear side 216. In other words, the RF aperture coldplate 202 is hollow between the front side 214 and the rear side 216 and around the waveguides 212. In an embodiment, for example, the RF antenna coldplate 202 includes recesses (not shown in FIG. 2) on the rear side 216 extending from one of the waveguides 212 to another one of the waveguides 212. FIG. 3, discussed in greater detail below, shows the recesses on the rear side 216. The waveguides 212 are partially filled with a dielectric material 220, which, as described above, is configured to propagate the RF signal through the dielectric material 220 (e.g., the feed radiators inject the RF signal into the dielectric material 220 because there is air behind the radiators, creating an electrical backshort due to the waveguide being below cut-off).

The RF aperture coldplate 202 is configured to function both as an RF antenna plate and a coldplate. The RF aperture coldplate 202 includes waveguides 212 each forming an opening through the RF aperture coldplate 202 from a front side 214 of the RF aperture coldplate to a rear side 216 of the RF aperture coldplate 202, and a plurality of passages 218 substantially around the waveguides 212 for conducting cooling medium around the waveguides 212 and between the front side 214 and the rear side 216. In other words, the RF aperture coldplate 202 is hollow between the front side 214 and the rear side 216 and around the waveguides 212. In an embodiment, for example, the RF antenna coldplate 202 includes recesses (not shown in FIG. 2) on the rear side 216 extending from one of the waveguides 212 to another one of the waveguides 212. FIG. 3, discussed in greater detail below, shows the recesses 220 on the rear side 216. The waveguides 212 are partially filled with a dielectric material 220, which, as described above, is configured to propagate the RF signal through the dielectric material 220 (e.g., the feed radiators inject the RF signal into the dielectric material 220 because there is air behind the radiators, creating an electrical backshort due to the waveguide being below cut-off).

The printed wiring board assembly 204 includes printed wiring boards (not shown in FIG. 2), each configured to be received by one of the recesses, and MICs (not shown in FIG. 2). In an embodiment, the printed wiring board assembly 204 includes dipoles (not shown in FIG. 2) arranged on a corresponding one of the printed wiring boards. One of ordinary skill would understand that the dipoles may be provided independently of the printed wiring board assembly 204, and affixed thereon. One of ordinary skill in the art would understand that although dipoles may be used in connection with the printed wiring board assembly 204, other antenna elements may be used depending on the specific application.

The enclosure 206, for example, is composed of an integral structure having channels 222, 224 to supply cooling medium to the RF aperture coldplate 202 (e.g., channel 222), and to expel the cooling medium from the RF aperture coldplate 202 (e.g., channel 224). The enclosure 206 is configured to receive the RF aperture coldplate 202 and the printed wiring board assembly 204. The channels 222, 224 are configured to conduct the cooling medium through the passages 218 of the RF aperture coldplate 202. FIG. 2 shows the direction of flow of the cooling medium as it flows in through the channel 222, through the passages 218, and out through the channel 224.

The RF matching layers 208, for example, include dielectric layers tuned to provide impedance matching for the RF signals propagated through the front of the waveguides. In an embodiment, the RF matching layers 208 provide wide angle impedance matching (WAIM) for the array. The RF matching layers 208 may include 4-5 dielectric layers that are tuned to provide the correct impedance match necessary for optimized operation of the antenna. The thickness and type of the dielectric layers may be used to tune the RF matching layers 208. A publication entitled Wideband Wide-Angle Impedance Matching and Polarization Characteristics of Circular Waveguide Phased Arrays," by Chao-Chun Chen, IEEE Trans. on Antennas and Propagation, Vol. AP-22, No. 3, May 1974, hereby incorporated by reference in its entirety, generally describes WAIM layers for a phased array antenna.

The radiators 210, for example, each consist of a dipole (dipole not shown in FIG. 2) arranged corresponding to respective ones of the MICs, and internal wiring of the printed wiring boards. These components are explained more fully with respect to FIG. 3.

FIG. 3 is a cross-sectional schematic block diagram illustrating an RF antenna system in accordance with an embodiment of the present invention.

Referring now to FIG. 3, an RF antenna system 300 in accordance with an embodiment of the present invention includes an RF aperture coldplate 302, a plurality of transmit-receive integrated microwave modules 304 (TRIMMs 304) and dielectric material 306.

The RF aperture coldplate 302, for example, is configured to function both as an RF antenna plate and a coldplate. The RF aperture coldplate 302 includes waveguides 308 each forming an opening through the RF aperture coldplate 302 from a front side 310 of the RF aperture coldplate to a rear side (not shown in FIG. 3, since FIG. 3 depicts a cross-sectional schematic block diagram of the RF antenna system) of the RF aperture coldplate 302, and a plurality of passages 312 substantially around the waveguides 308 for conducting cooling medium around the waveguides 308 and between the front side 310 and the rear side (not shown). In other words, the RF aperture coldplate 302 is hollow between the front side 310 and the rear side and around the waveguides 308. In an embodiment, for example, the RF antenna coldplate 302 includes recesses 314 on the rear side 312 extending from one of the waveguides 308 to another one of the waveguides 308.

The plurality of TRIMMs 304, for example, each include a printed wiring board 316, configured to be received by one of the recesses 314, and MICs (not shown in FIG. 3, since FIG. 3 is a cross-sectional representation of the RF aperture coldplate 302). In an embodiment, the TRIMMs 304 include dipoles 318 arranged on a corresponding one of the printed wiring boards 316. One of ordinary skill would understand that the dipoles 318 may be provided independently of the plurality of TRIMMs 304, and affixed thereon. The dipoles 318, for example, include a pair of monopoles, one monopole affixed to one side of a corresponding one of the printed wiring boards 316, and the other monopole affixed to the other side of the one of the printed wiring boards 316. One of ordinary skill in the art would understand that although dipoles 318 may be used in connection with the plurality of TRIMMs 304, other antenna elements may be used depending on the specific application.

The dielectric material 306, for example, is configured to propagate the RF signal through the dielectric material 306 (e.g., the feed radiators inject the RF signal into the dielectric material 306 because there is air behind the radiators, creating an electrical back-short due to the waveguide being below cut-off).

Figure 4:
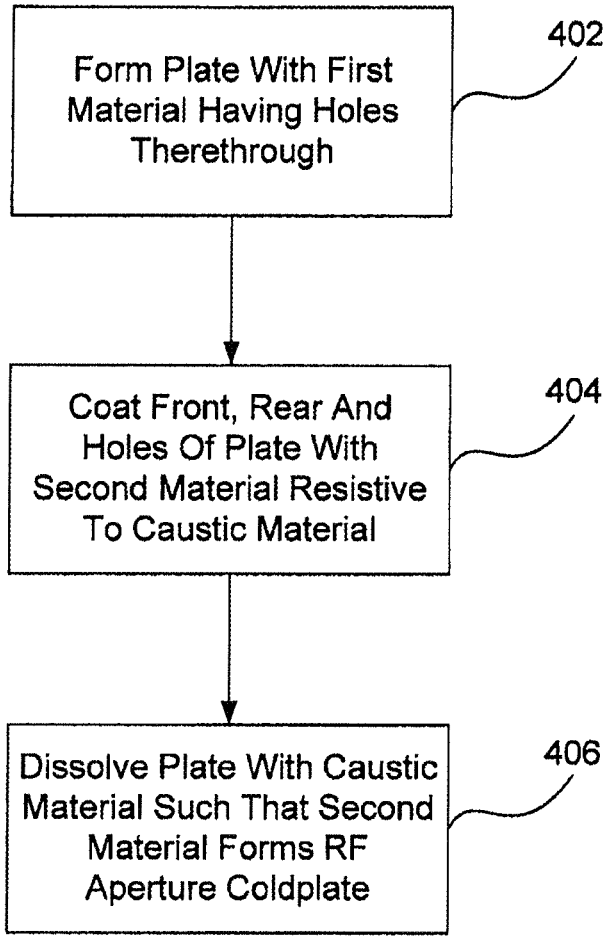
FIG. 4 is a flow diagram illustrating a method of manufacturing an RF aperture coldplate in accordance with an embodiment of the present invention.

FIG. 4 is a flow diagram illustrating a method of manufacturing an RF aperture coldplate in accordance with an embodiment of the present invention.

Referring now to FIG. 4, the method of manufacturing an RF aperture coldplate in accordance with an embodiment of the present invention includes, at Block 402, forming a plate with a first material susceptible to being dissolved by a caustic material, the plate having a plurality of holes therethrough. The plate, for example, is composed of aluminum, which is susceptible to being dissolved by a caustic material such as an alkali metal hydroxide. In an embodiment, the plate is formed with recesses on a rear side of the plate. The plate is formed to act as a reverse mold, which when plated (e.g., coated) with a material resistive to the caustic material, may be dissolved by the caustic material, resulting in only the plated material.

At Block 404, a front surface, a rear surface and the holes of the plate are coated with a second material resistive to the caustic material. For example, the second material is copper. Metals such as Ni, Pt, Os, Pd, Ru, Re, Rh, Au, Ir, Co, Fe, Mo, Cu and Ag may have caustic properties. One of ordinary skill in the art would understand the various reactions of the first material and the second material to a specified caustic material. For example, an electroforming process is used to coat the outer surfaces of the plate.

At Block 406, the plate is dissolved with the caustic material such that the second material forms an RF aperture coldplate. The first material, the second material and the caustic material may be selected to ensure that the plate is mostly (or entirely) dissolved, and the second material is not dissolved by the caustic material. One of ordinary skill in the art would understand that the resulting structure of the second material may be washed (e.g., flushed) to remove all excess first material. The resulting RF aperture coldplate has a front side, a rear side, and includes a plurality of waveguides each forming an opening through the RF aperture coldplate from the front side to the rear side. The RF aperture coldplate includes passages substantially around the waveguides for conducting cooling medium around the waveguides and between the front side and the rear side of the RF aperture coldplate.

Figure 5:
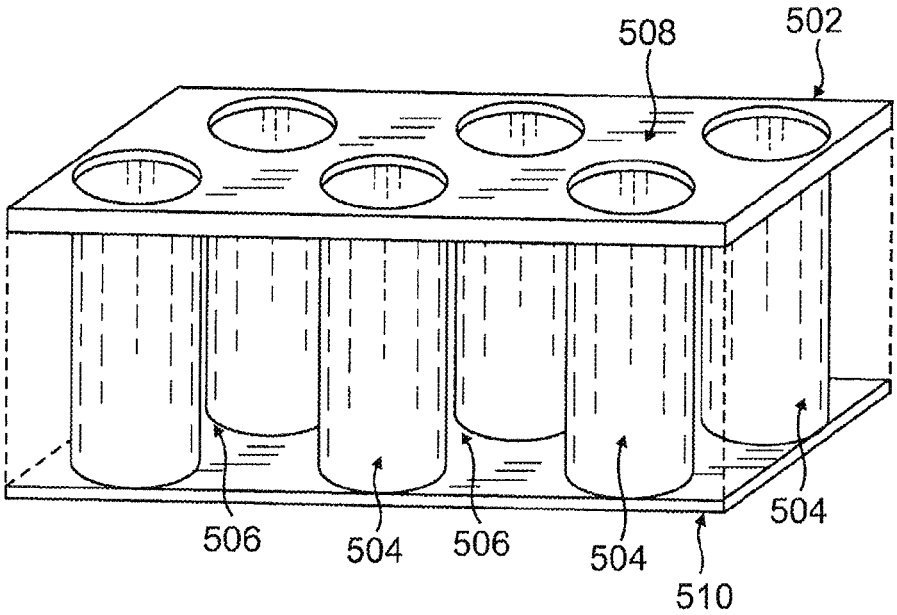
FIG. 5 is a schematic block diagram illustrating an RF aperture coldplate in accordance with an embodiment of the present invention.

FIG. 5 is a schematic block diagram illustrating an RF aperture coldplate in accordance with an embodiment of the present invention.

Referring now to FIG. 5, the RF aperture coldplate 502 includes a plurality of waveguides 504 and a plurality of passages 506. The RF aperture coldplate 502 also includes at least one recess (not shown in FIG. 5) that is utilized to receive a printed wiring board assembly.

The plurality of waveguides 504 each forms an opening through the RF aperture coldplate 502 from a front side 508 of the RF aperture coldplate 502 to a rear side 510 of the RF aperture coldplate 502.

The passages 506 are substantially around the waveguides 504 for conducting cooling medium around the waveguides 504 and between the front side 508 and the rear side 510. In other words, the RF aperture coldplate 502 is hollow between the front side 508 and the rear side 510 and around the waveguides 504. In an embodiment, for example, the RF antenna coldplate 502 includes recesses (not shown) on the rear side 510 extending from one of the waveguides 504 to another one of the waveguides 504. The waveguides 504 are partially filled with a dielectric material (not shown), which, as described above, is configured to propagate the RF signal through the dielectric material (e.g., the radiators propagate the RF signal through the dielectric material because the radiators are surrounded by air, creating an electrical backshort).

In an embodiment, although not drawn to scale, the RF aperture coldplate 502 is the result of the method of manufacturing an RF aperture coldplate in accordance with an embodiment of the present invention illustrated in the flow diagram of FIG. 4.

The RF aperture coldplate 102, the RF aperture coldplate 202, the RF aperture coldplate 302 and the RF aperture coldplate 502 may be substantially similar in nature. While each of the FIGS. 1-3 and 5 identify different numbers of waveguides, of various shapes, sizes and proportions, one of ordinary skill in the art would understand that the size, shape and proportions of the RF aperture coldplate depends on the application of the RF system. For example, an RF system operating in the X-band (8.0-12.0 GHz) would use different sized waveguides than an RF system operating in the Q-band satellite communications sub-band (40.0-45.0 GHz).

Therefore, there is presented an RF antenna system in accordance with embodiments of the present invention including an RF aperture coldplate, in which the RF aperture coldplate functions as a coldplate for circulating cooling medium in close proximity to heat generating elements of an RF system, and as an antenna plate, for use with circular waveguide antenna elements. The RF antenna system presented herein may provide increased cooling performance and reduces mechanical tolerance issues for ease in manufacturing.

What is claimed is:

1. A method of manufacturing a radio-frequency aperture coldplate for positioning in heat transfer proximity to heat-generating elements of a radio-frequency antenna system, the radio frequency aperture coldplate having a front side and a rear side and comprising a plurality of waveguides each forming an opening through the radio-frequency aperture coldplate from the front side to the rear side, the method comprising:

forming a plate with a first material susceptible to being dissolved by a caustic material, the plate having a plurality of holes therethrough;

coating a front surface, a rear surface and the plurality of holes of the plate with a second material resistive to the caustic material; and dissolving the plate with the caustic material such that the second material forms the radio-frequency aperture coldplate.

2. The method of claim 1, wherein the plate has at least one recess such that after the plate is dissolved with the caustic material, the radio frequency aperture coldplate further comprises at least one recess on the rear side extending from one of the plurality of waveguides to another of the plurality of waveguides.

3. The method of claim 2, wherein the at least one recess is configured to receive a printed wiring board assembly comprising at least one printed wiring board and a plurality of microwave integrated circuits, the plurality of microwave integrated circuits each aligned with a respective one of the plurality of waveguides.

4. The method of claim 3, wherein the plurality of waveguides is configured to receive a plurality of dipoles each coupled to the printed wiring board assembly and positioned substantially within a respective one of the plurality of waveguides.

5. The method of claim 1, wherein the radio-frequency aperture coldplate is configured to be received in an enclosure comprising at least one inlet for supplying the cooling medium to the radio-frequency aperture coldplate, and at least one outlet for expelling the cooling medium from the radio-frequency aperture coldplate.

6. The method of claim 1, wherein the first material is aluminum.

7. The method of claim 1, wherein the second material is at least copper.

* * * * *